US005304032A

United States Patent [19]

Bosna et al.

[11] Patent Number: 5,304,032

[45] Date of Patent: Apr. 19, 1994

[54] ABRADABLE NON-METALLIC SEAL FOR ROTATING TURBINE ENGINES

[76] Inventors: Alexander A. Bosna, 135 Summit Rd., Malvern, Pa. 19355; Louis M. Riccio, P.O. Box 81, DeVault, Pa. 19432

[21] Appl. No.: 733,559

[22] Filed: Jul. 22, 1991

[51] Int. Cl.[5] ..... F03B 3/16

[52] U.S. Cl. ..... 415/200; 415/173.4; 415/174.4; 415/230; 427/243; 427/447

[58] Field of Search ..... 277/53; 415/170.1, 173.4, 415/174.4, 229, 230; 29/888.3; 264/162; 427/423, 243

[56] References Cited

U.S. PATENT DOCUMENTS 1,853,923 12/1928 Hoffmann ..... 415/170.1
3,547,455 2/1970 Dubnt ..... 277/53
4,460,185 7/1984 Grandey ..... 277/53
4,566,700 1/1986 Shiembob ..... 277/53
4,597,582 7/1986 Müller ..... 277/53

*Primary Examiner*—Edward K. Look
*Assistant Examiner*—Mark Sgantzos
*Attorney, Agent, or Firm*—Jim Zegeer

[57] ABSTRACT

A turbine engine having an interior housing and one or more annular abradable seals for the turbine blades. The abradable seal comprises a resin having fractured hollow inorganic non-metallic microspheres forming nooks, crannies and undercuts in the resin and a solid lubricant in the resin and in the nooks and crannies and undercuts formed by the fractured hollow non-metallic inorganic microspheres.

12 Claims, 6 Drawing Sheets

ABRADABLE NON-METALLIC SEAL FOR ROTATING TURBINE ENGINES

BACKGROUND AND BRIEF DESCRIPTION OF THE INVENTION

Efficiency of rotating aircraft turbine engines (as opposed to reciprocating) depends partially on the efficient air compressor section which, in turn, depends on the clearance control between blade tips and the adjacent surfaces. The analogy would be the fit up and clearance of a piston ring and cylinder wall for an efficient compression stroke.

Because of the close assembly tolerances and the thermal expansion of the parts, a close clearance is maintained by having an abradable material opposite the tips of the blades. The blades cut their own groove or path, thereby minimizing leakage of air around the tips of the blades. Each engine has rows of moving blades mounted on rotating disks with rows of stationary blades in between each rotation section to redirect the flow into the next rotating stage. The stationary blade tips cut their groove into the rotating seal attached to the rotating compressor disk.

The performance of the abradable seal material is such that while it must be abradable and not abrade the tips of the blades, it cannot stick to the blades. It must also be able to stand the elevated temperature due to compression as well as the erosion of abrasive particles injected into the intake air. The dynamic seal material must also have excellent bond strength to withstand the centrifugal forces induced at 30 to 40,000 rpm. Moreover, when the unit is stopped and parts are in contact, a lower coefficient of friction would facilitate starting by reducing drag forces at the interfaces of the seal material and blade tips.

In titanium bladed auxiliary power units (A.P.U.) a problem exists that when the unit remains stationary, particularly in humid and/or salty atmospheres, the titanium blades tend to seize against the abradable seal. This is because the abradable seal material is about 85% aluminum, or aluminum bronze, which are very much apart on the anodic chart with titanium and hence there is accelerated galvanic-type erosion of the aluminum alloy causing a seizing at the seal interface. The solution appeared to be in a non-metallic abradable seal material.

The present commercial system that has been widely accepted by the aerospace industry is a system which calls for thermal spraying a mixture of aluminum powder and resin (85% aluminum and 15% resin). The process includes grit blasting the surface, applying a bond coat by thermal spray for better adhesion, then thermal (plasma) spraying the aluminum or aluminum bronze powder, machining this deposit to dimensional requirements, then a seal coat of a resin is applied to impregnate the sprayed deposit. Because the spray process must spray the aluminum powder and resin separately into the plasma, there at at least 15 variables and Taguchi Statistical Process Control methods are constantly applied every time some of these variables are changed.

In other similar systems, the material is also an aluminum or aluminum bronze spray powder with a polyimide powder rather than a polyester powder. None of the versions address the galvanic problem.

A Teflon TM (a synthetic resin polymer, solid lubricant) coating is placed over a high temperature resin microsphere mix after the substrate has been machined to allow a coating of 5 mils to be added to the surface.

This type of abradable seal solved many of the above problems. However, if the Teflon TM particles on the surface were fully nucleated or melted together rather than just sintered, the coating in the thicker areas would tend to peel rather than abrade. Moreover, due to the dimensional tolerances, and difficulty and economics of applying a thick (.003" or over) coating of Teflon TM, it was more realistic to assume that the wear of the blade tips would penetrate into the substrate.

In a preferred embodiment of the invention the Teflon TM coating is eliminated and solid lubricant Teflon TM is incorporated into the microsphere and high temperature resin mix.

From wear tests and metallographic examinations of the surfaces, it appears that some of the Teflon TM or solid lubricant particles embedded in the resin break loose and are trapped in the cavities, nooks and crannies of the microspheres on the surface, thus producing a lower friction force. The friability and the frangibility of this system enables the wear to take place in the abradable seal material without wear or adherence to the titanium blade tips. This system has about ⅓ the variables that are in the present system and does not require the use of an expensive plasma or high velocity thermal spray system and associated equipment.

In a further preferred embodiment, ceramic fibers are incorporated into the resin, microsphere Teflon TM mix.

The basic objectives of the invention are to provide an improved abradable seal for rotating turbine engines and a method of producing same.

DESCRIPTION OF THE DRAWINGS

The above and other objects, advantages and features of the invention will become more apparent when considered with the following specification and attached drawings wherein.

DETAILED DESCRIPTION OF THE INVENTION

Figure 1B:
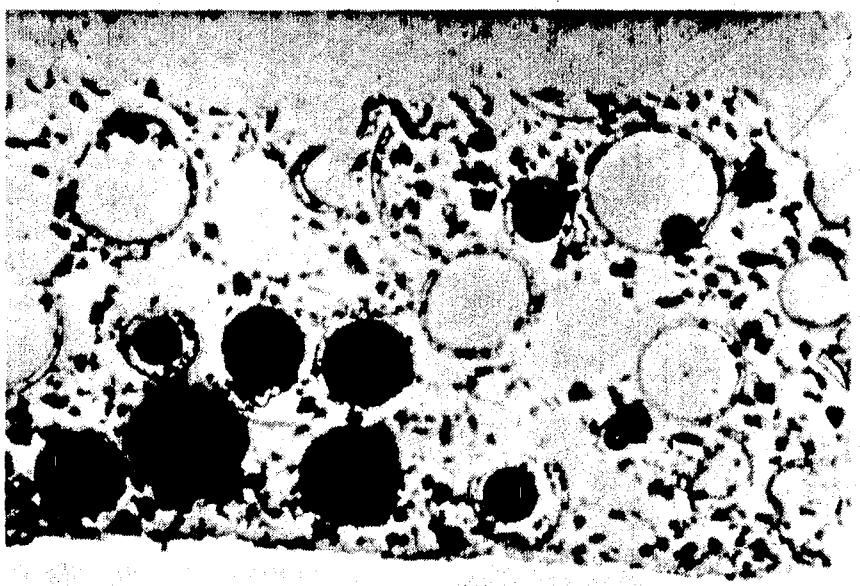
FIGS. 1A–5B are photomicrographs of abradable seals incorporating the invention, and FIG. **6*a* is a section through one stage of a turbine engine.

A diagrammatic illustration of the abradable seals of a rotating aircraft turbine engine is shown in FIG. **6*a***. The efficiency depends partially on an efficient air compressor section which, in turn, depends on the clearance control between rotating blade tips BT and adjacent stationary surfaces SC. Because of close assembly tolerances and thermal expansion of parts, a close clearance is maintained by having an abradable material opposite the tips of the blades on the adjacent surfaces so that the blades cut their own groove or path to thereby minimize leakage of air around the blade tips and thus enhance the efficiency.

Referring collectively to FIGS. **6*a*, 6*b* and 6*c*, a stage portion 10 of a air compressor section of a multistage turbine engine has a fixed housing 11, a shaft 12 carrying rotatable compressor rotor discs 13 having outwardly extending blades 14 (which may be titanium or other compressor blade alloy), and an abradable seal ring 15 on rotating compressor disc ring 16. The tips 17** of rotor blades 14 engage stationary abradable seal ring 18 formed on the interior of housing 11 adjacent stationary blades 19 which are secured to housing 11 and have tips 20 which engage rotating abradable seal ring 15.

According to this invention, the abradable seal surfaces 15 and 18 are provided with a coating comprised of a mixture of Teflon TM, hollow-microspheres of ceramic or glass and a high temperature resin (RTM). To form the seals 15 and 18, some of the Teflon TM particles embedded in the resin break loose and are trapped in the cavities, nooks and undercuts of fractured microspheres on the surface to produce a lower friction non-galvanic surface. The friability and frangibility of this system enables the wear to take place in the seal material without wear or adherence to the blade tips, which may be titanium.

The high temperature resin has the character of gray viscous paste Teflon TM is a white powder and the microspheres are free flowing.

In a further preferred embodiment, ceramic fibers, which a needle-like pieces of ceramic ⅛" to 100 microns long, are incorporated into the high temperature resin, microsphere and Teflon TM mix for additional strength especially in order to withstand the hoop stresses induced by the high rotational speeds of the compressor disks.

The use of a thermo-set resin, using a hardener, makes use of epoxy and polyamide-imide materials that have a high glass transition temperature (Tg) and a high heat deflection temperature (HDT). These properties are enhanced with the addition of the ceramic fibers, microspheres and Teflon TM powders.

The resin, Teflon TM and microspheres (RTM) formulation is preferably applied to the turbine's surfaces which have been heated to over 100 degrees Fahrenheit (125–150 degrees) and kept at that temperature by a hot air blower. The RTM mix should be applied in a manner to prevent folding in or entrapment of air, and an excess of material is added to allow for machining to final dimensions. However, excessive thickness may cause sagging which should be avoided. The parts are preferably rotated to allow major voids to surface and be eliminated, and then cured in an oven (3 hrs. @ 100 degrees C. and 180 degrees C. for 1 hr.) while the part or parts are rotated at about 6 rpm. At the end of the curing cycle the parts are cooled slowly to at least 70 degrees C. The RTM mix can be thermally sprayed while rotating the part on which the abradable seal is to be formed.

The following ratios of resin to fillers are percentages by weight of a preferred embodiment:

50/35 ratio of resin to microspheres to this is added 45 to 50% of Teflon TM plus 12–13% ceramic fibers, example:

100 gms of resin +35% by weight of microspheres, i.e.

65 gms resin 35 gms microspheres

40–45 gms Teflon TM

12–13 gms ceramic fibers

The Resin and Fillers are blended uniformly for 5 minutes. Slight warming will lower viscosity for easier handling, the resin mix is then vacuum degased for 3 minutes at 28" Hg.

Appropriate amounts are screed onto the surface to provide a minimum of about 0.060 thickness coating on the test samples described below.

Parts are placed in a curing oven for 3 hours at 100 degrees C. and 1 hour at 180 degrees C. and allowed to cool to 150 degrees before removing from oven.

Surface of samples are machined to a 120 micron finish and the surface is air blasted clean. The surface is inspected at 30× to 50× to insure removal of particles from the fractured microsphere cavities and undercuts.

TENSILE TESTING

Tensile tests are performed on each of the two sample pieces per conventional ASTM tensile tests.

Minimum tensile test results should average 2000 psi with no value lower than 1750 psi.

Figure 1A:
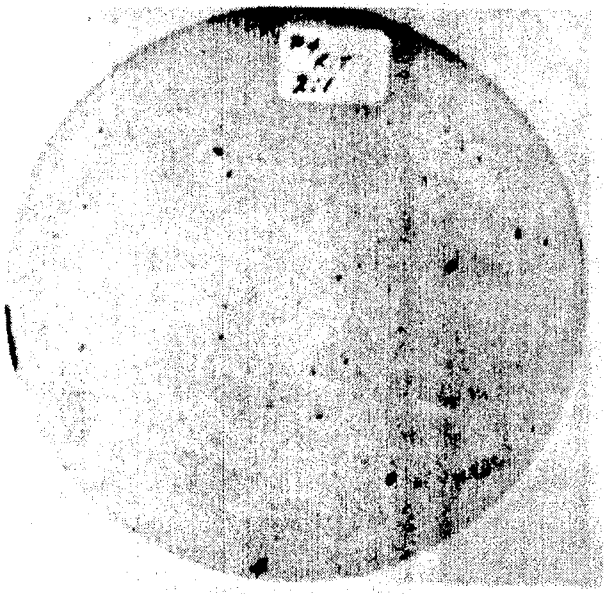
Figure 2B:
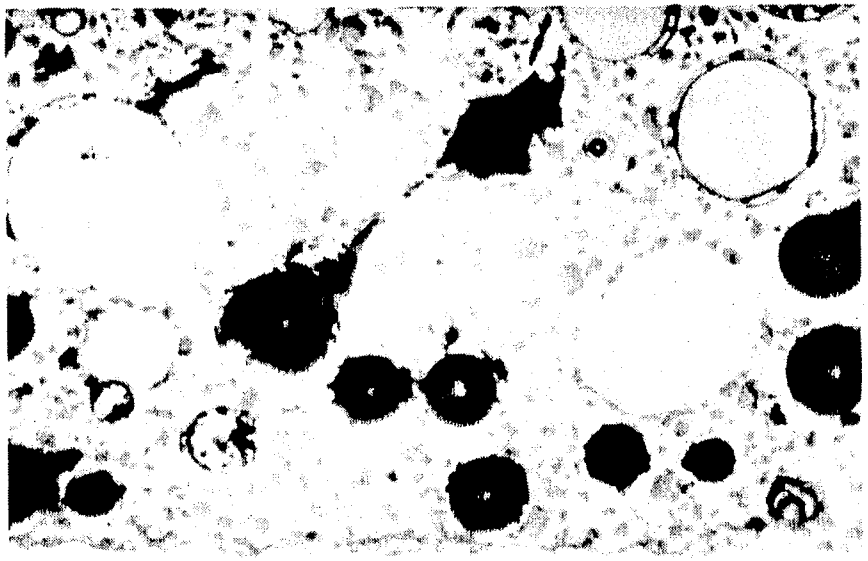
Figure 2A:
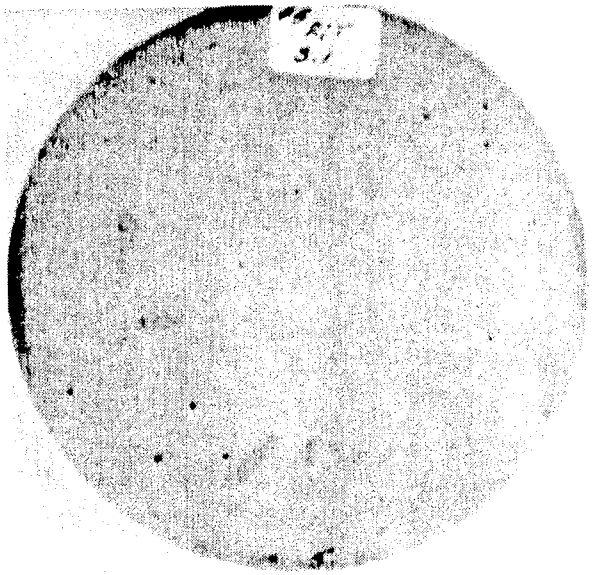
Figure 3B:
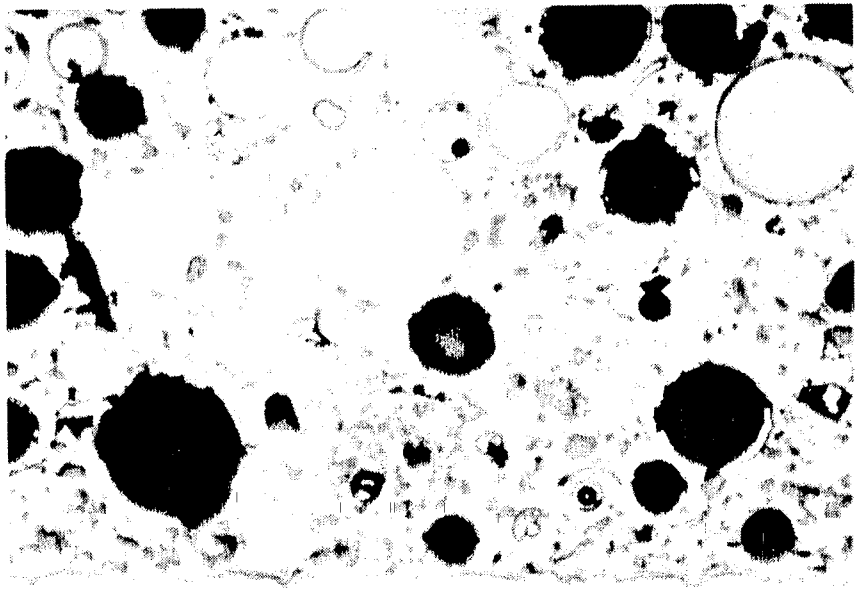
Figure 3A:
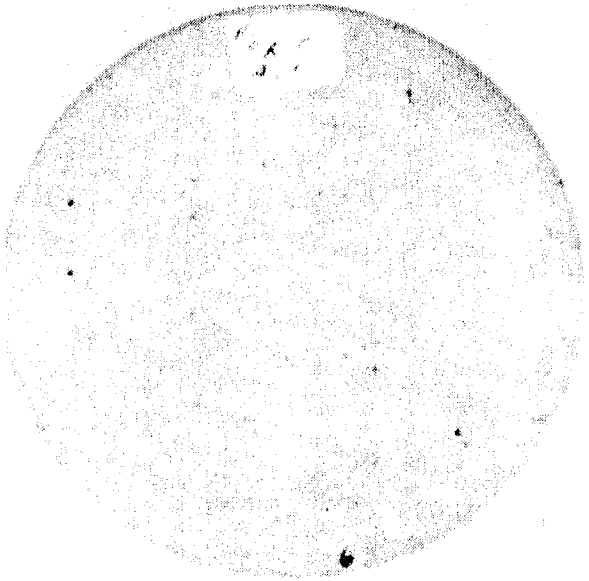
Figure 4B:
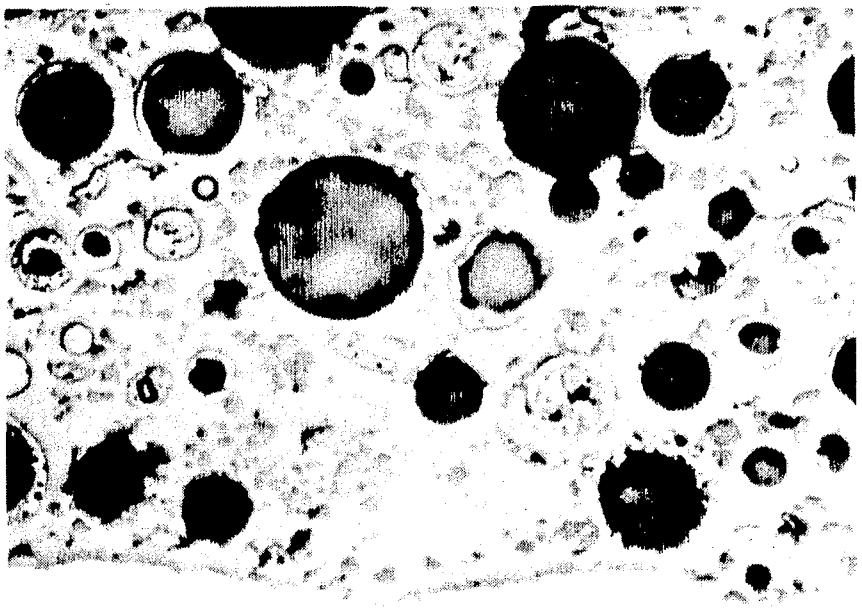
Figure 4A:
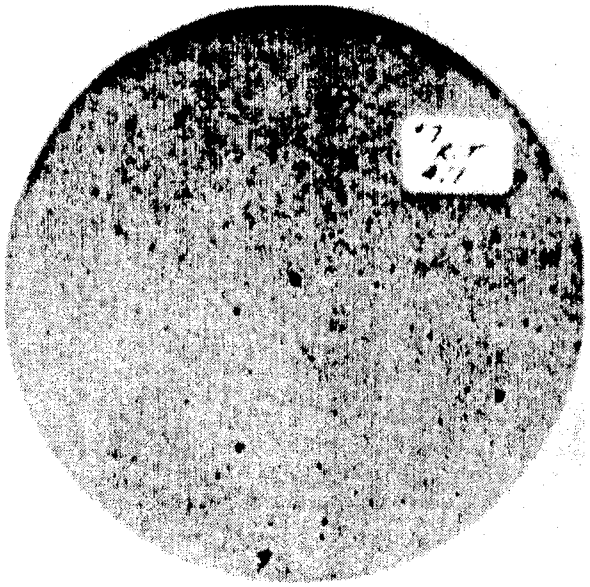
Figure 5B:
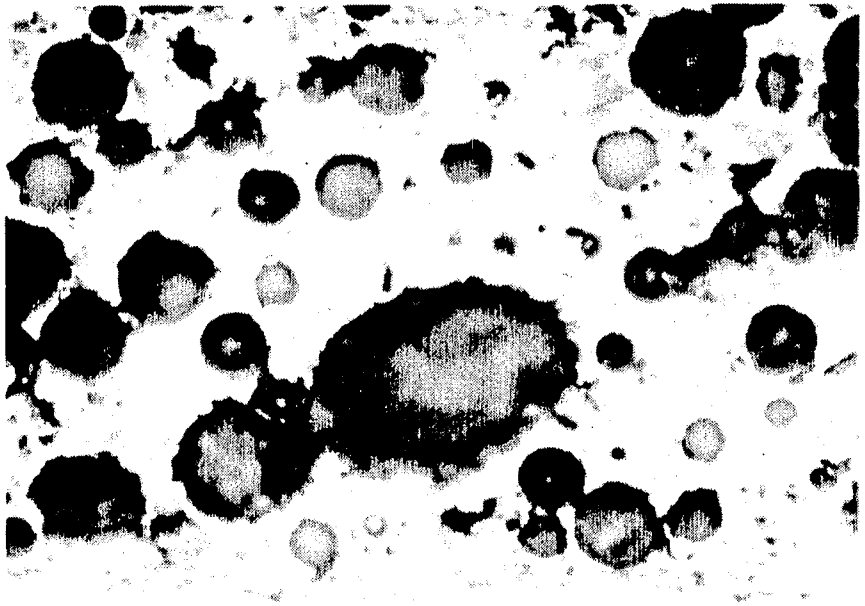
Figure 5A:
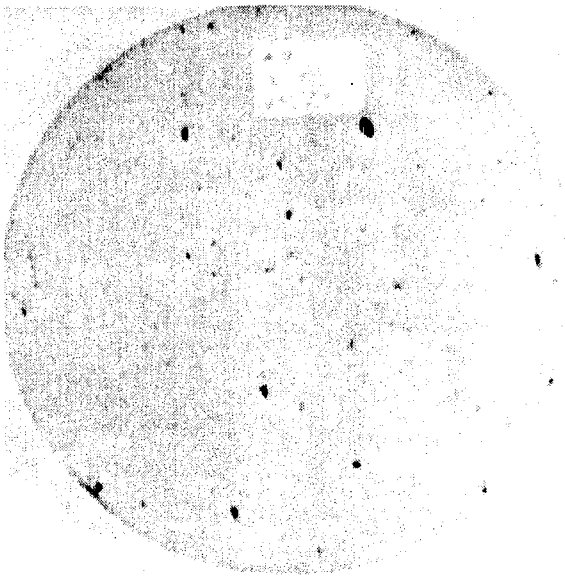

Five samples of abradable coatings were tested for tensile strength. The samples were as shown below:

| SAMPLE NO. | RESIN TO TEFLON TM | BY WEIGHT |
|---|---|---|
| 1 | 2 to 1 | (FIGS. 1A and 1B) |
| 2 | 3 to 1 | (FIGS. 2A and 2B) |
| 3 | 4 to 1 | (FIGS. 3A and 3B) |
| 4 | 4 to 1 | (FIGS. 4A and 4B) |
| 5 | 45 to 23 | (FIGS. 5A and 5B) |

MICROEXAMINATION

The samples were cross-sectioned and prepared for examination. All five coatings showed good adhesion to the substrate. Porosity varied from approximately 15 to 20% on Samples No. 1 and 2 to approximately 50% on Sample 5. No cracking was present in any of the samples, FIGS. 1 through 5, respectively.

COEFFICIENT OF FRICTION

The coefficient of friction for the five samples was determined as shown below:

| SAMPLE NO. | KINETIC COEFFICIENT OF FRICTION | STATIC COEFFICIENT OF FRICTION | RESIN TO TEFLON |
|---|---|---|---|
| 1 | .173 | .360 | 2 TO 1 |
| 2 | .168 | .312 | 3 TO 1 |
| 3 | .190 | .325 | 4 TO 1 |
| 4 | .203 | .302 | 4 TO 1 |
| 5 | .190 | .472 | 45 TO 23 |

MECHANICAL TESTS

Figure 6A:
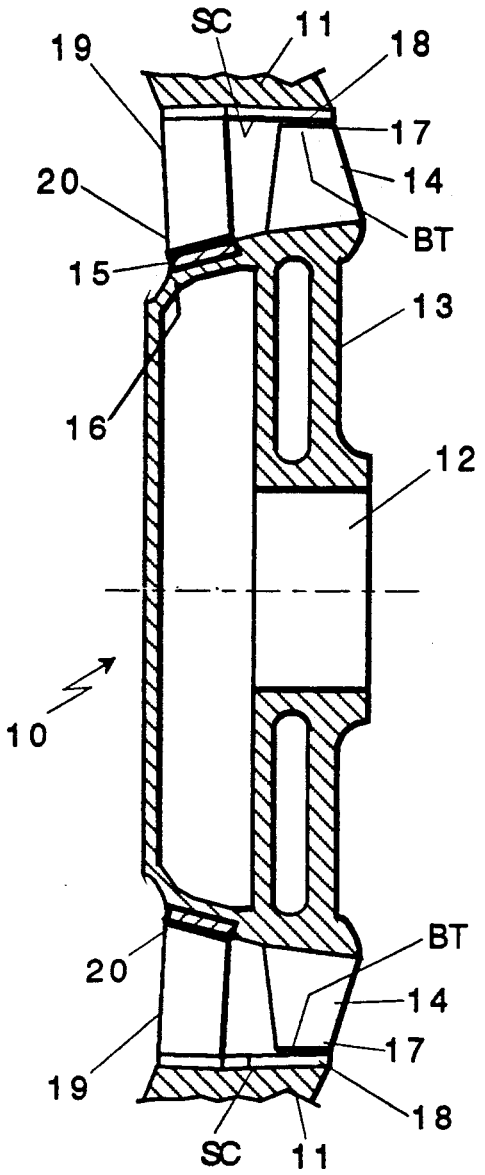
FIG. 6*b* is a section through the abradable seal on the stationary ring.
FIG. 6*c*** is a section through the abradable seal on the rotating compressor disc.
Figure 6C:
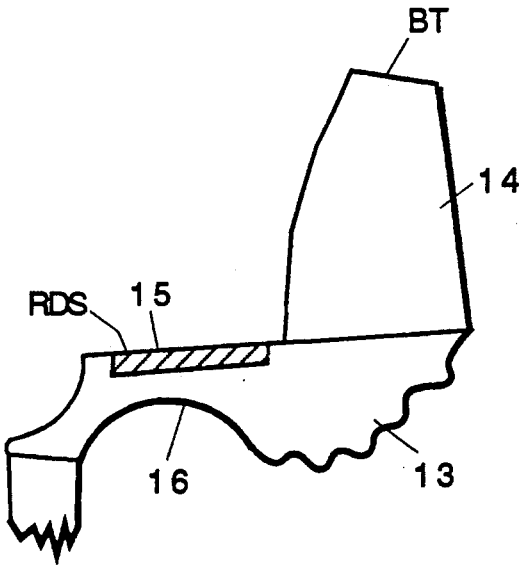
Figure 6B:
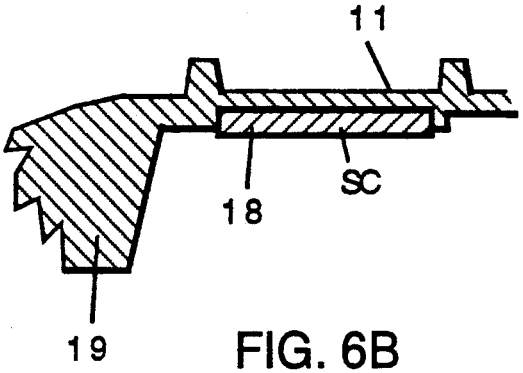

The samples were adhesively bonded with epoxy as shown in FIG. 6 and mechanically tested to determine tensile properties and location of failure. The test results are shown below:

| SAMPLE NO. | TENSILE STRENGTH PSI | LOCATION OF FAILURE |
|---|---|---|
| 1 | 2700 | COATING |
| 2 | 2550 | COATING |
| 3 | 2700 | COATING |
| 4 | 2750 | COATING |
| 5 | 1150 | COATING |

CONCLUSION

From the preceding examination we may make the following observations:

a. No disadhesion from the substrate or cracking was present on any of the samples.

b. The amount of porosity varied from approximately 15% to 50% between the samples.

c. The tensile strengths were consistent, ranging from 2550 to 2750 PSI, except on Sample 5, where the tensile strength was 1150 PSI.

While there has been shown and described a preferred embodiment of the invention, it will be appreciated that other embodiments will be readily apparent to those skilled in the art and it is desired to encompass such obvious modifications and variations within the spirit and scope of the claims appended hereto.

What is claimed is:

1. In an turbine engine having an interior housing and an annular abradable seal on the interior, a rotor, rotating turbine blades on said rotor engaging said annular abradable seal, the improvement wherein said abradable seal comprises a resin, fractured hollow inorganic non-metallic microspheres forming nooks, crannies and undercuts in said resin and a solid lubricant in said resin and in the nooks and crannies and undercuts formed by said fractured hollow non-metallic microspheres.

2. The invention defined in claim 1 wherein said interior surface of said housing has a set of fixed turbine blades secured thereto and having an annular relation to said rotating turbine blades, and a rotatable annular abradable seal, said rotatable annular abradable seal being on said rotor with said fixed turbine blades engaging said rotatable annular abradable seal, said rotatable annular abradable sea comprising a mix of a resin, a solid lubricant and fractured hollow non-metallic microspheres.

3. The invention defined in claim 1 or claim 2 wherein said annular abradable seals include ceramic fibers in said resin.

4. The invention defined in claims 1 or 2 wherein said resin constitutes about 50% by weight of said abradable seal.

5. The invention defined in claims 1 or 2 wherein said resin is a high temperature resin and constitutes about 50% by weight of said abradable seal.

6. A method of forming an abradable seal ring on one or more surfaces of a turbine engine having turbine blades engagable with said one or more abradable seal rings comprising the steps of:

preparing a non-metallic mixture of a high temperature resin, a solid lubricant and microspheres, heating said one or more surfaces, applying said non-metallic mixture to said surfaces, curing said non-metallic mixture, machining the cured non-metallic mixture and removing all machined particles therefrom, and engaging the machined surface with said turbine blades to provide nooks, crannies and undercuts in said machined surface, and by relative contact between said turbine blade tips and said machined surface causing particles of said solid lubricant to break loose and become trapped in said nooks, crannies and undercuts.

7. The method defined in claim 6 including combining said resin, solid lubricant and microspheres to form said non-metallic mixture and wherein the ratio of high temperature resin in sand non-metallic mixture to solid lubricant and microspheres is about 50%.

8. The method defined in claim 6 wherein said one or more surfaces is rotated during curing.

9. The method defined in claim 8 wherein said one or more surfaces are heated during rotation.

10. The method defined in claim 8 including combining said resin, solid lubricant and microspheres with a non-metallic fibers to constitute said non-metallic mixture.

11. The method in claim 6 wherein a filler is added for rheological and viscosity control.

12. The method defined in claim 6 wherein said non-metallic mixture is thermally sprayed on said surfaces to constitute said applying.

* * * * *